US005549100A

United States Patent [19]

Heisner et al.

[11] Patent Number: 5,549,100

[45] Date of Patent: Aug. 27, 1996

[54] PLATE OF GLASS CERAMIC AS COMPONENT OF A COOKING APPLIANCE

[75] Inventors: Thomas Heisner, Mainz; Jürgen Naubik, Eich; Karl-Heinz Juras, Mainz, all of Germany

[73] Assignee: Schott Glaswerke, Mainz, Germany

[21] Appl. No.: 314,743

[22] Filed: Sep. 29, 1994

[30] Foreign Application Priority Data

Sep. 30, 1993 [DE] Germany ..... 43 33 334.6

[51] Int. Cl.[6] ..... F24C 3/00

[52] U.S. Cl. ..... 126/39J; 126/214 R; 126/214 A; 126/39 R

[58] Field of Search ..... 126/39 J, 214 R, 126/214 A, 39 R

[56] References Cited

U.S. PATENT DOCUMENTS

| | | | |
|---|---|---|---|
| 3,830,216 | 8/1974 | Dodd | 126/39 J |
| 3,832,988 | 9/1974 | Doner | 126/39 J X |
| 5,139,007 | 8/1992 | Martinez | 126/39 J |

FOREIGN PATENT DOCUMENTS

| | | |
|---|---|---|
| 0210780 | 2/1987 | European Pat. Off. . |
| 0464323 | 4/1991 | European Pat. Off. . |
| 0570669 | 11/1993 | European Pat. Off. . |
| 0570670 | 11/1993 | European Pat. Off. . |
| 3838176 | 5/1989 | Germany . |
| 9000733.6 | 5/1990 | Germany . |
| 9013064.2 | 1/1991 | Germany . |
| 4216677 | 11/1993 | Germany . |

*Primary Examiner*—Larry Jones
*Attorney, Agent, or Firm*—Millen, White, Zelane, & Branigan, P.C.

[57] ABSTRACT

The invention relates to a plate of glass ceramic suitable as component of a cooking appliance with at least one region of the one-piece plate deviating from the main plane of the plate.

21 Claims, 4 Drawing Sheets

PLATE OF GLASS CERAMIC AS COMPONENT OF A COOKING APPLIANCE

SUMMARY OF THE INVENTION

The invention relates to a plate of glass ceramic material such as used as a component of a cooking appliance, in particular a regulatable appliance heated by electricity and/or gas.

Such cooking appliances have already been frequently described in the patent literature and are, therefore, sufficiently known.

These cooking appliances have a control panel having regulators, visual displays for information about the current operating state of the oven and the individual cooking areas, and any appliance clock present. In general, the control panel is below the working plate which projects over the control panel. The glass ceramic plate is integrated into the working plate of the appliance as a cooking area.

The control panel with all its controls and displays is, therefore, particularly when working on the working plate or the cooking area itself, difficult or impossible to see for ergonomic reasons and, therefore, also not safe to operate.

Likewise, embodiments of appliances are known in which the cooking area and the control panel are connected to a common frame construction.

The cooking area and the control panel here comprise various materials. The control panel is lavishly screwed to the frame parts so that assembly is complicated and mounting on such frames and the fasteners required therefor is very costly.

Care and cleaning in practical use are also difficult in this embodiment of an appliance because of the many, sometimes hardly accessible, edges.

Furthermore, level glass-ceramic cooking areas having controls integrated into the glass-ceramic surface are known on the market.

For this purpose, recesses and drilled holes for leading through the controls and the displays are present in the glass-ceramic plates at the side of the cooking zones marked by decoration. Such recesses can be made by drilling, by cutting with a water jet (i.e., a water torch), or by using an ultrasonic drilling machine.

Such an appliance construction has, however, the decisive disadvantage that material overflowing during cooking can get under the controls and can only be removed again therefrom with great difficulty.

For the same reason, very complicated measures are necessary to seal the passages against the penetration of contaminants of every type.

The visual readability of the visual displays often also leaves something to be desired in these arrangements lying in one plane.

DE 33 37 148 A1 discloses a hob having an upper plate of glass-like and/or ceramic material which is mounted in a tub-like seat of a support frame on a sealing bed and is overlapped at the margin by an upper cover frame which can be braced against the support frame, with the support frame having an essentially vertical circumferential and shapestable frame side on which the sealing bed is located and above which the cover frame overlapping the plate margin rests on the plate.

FIG. 1 of DE 33 37 148 A1 shows that on reverse side of the hob the profile of the cover frame is likewise essentially T-shaped, except that in this case a shoulder formed inward toward the plate has joined to it an extension frame running obliquely upward, which frame, for example, bears a likewise plate-like nameplate of circuit support.

This also results in a very complicated hob construction having all the disadvantages and sealing problems of multicomponent constructions.

It is, therefore, an object of the invention to avoid 10 the above-mentioned disadvantages and weaknesses of constructions and embodiments used hitherto and, in addition, to make possible very convenient operation, particularly in respect of the readability of the controls and the visual displays. Furthermore, it is an object of the invention to propose a novel, functional embodiment of a plate of glass-ceramic as a cooking area, which can be simply mounted without great changes in existing constructions and whose need for additional frame components and fasteners is minimal.

Upon further study of the specification and appended claims, further objects and advantages of this invention will become apparent to those skilled in the art.

These objects are achieved by a glass-ceramic plate in which at least one region of the one-piece plate deviates from the main plane of the plate.

In this plate, the regions deviating from the main plane of the plate form angles of preferably about 15° –120° with the main plane and have radii of preferably about 4 mm-100 mm. Radii refers to the distance from the point of deflection from the main plane of the plate to the edge of the deviating region or to a subsequent point of deflection.

This innovation in a technically very mature field in the final analysis give decisive technical advantages, although just the experimental departure from the accustomed level construction of previous glass-ceramic cooking surfaces faces initially raises certain constructive and functional concerns among manufacturers and users.

It is here particularly advantageous if one or more regions of the one-piece plate deviate upward from the main plane, since this gives a pan-like geometry which, for example, can contain without problems even relatively large amounts of material overflowing during cooking.

In addition, the regions angled upward provide very effective spatter protection, particularly against soiling by fat which is often encountered in the environment of cooking appliances.

Such soiling by fat, particularly on floor surfaces, creates, among other things, a hazard for persons working in the vicinity of these cooking appliances as a result of the danger of slipping.

In a further embodiment, regions of the one-piece plate can also deviate downward.

This gives, first and foremost, advantages in assembly, since the downward deviating, in particular angled, regions can be accurately fitted into given frame constructions and the support areas, in contrast to planar mounting of the plates, are accurately defined in the frame.

As a result, the replaceability of the plates is also made considerably easier and could, with a suitable frame construction of the cooking appliance, even be undertaken by lay persons.

For example, the deviating region is bent over to form a further plane which is parallel to the main plane of the plate. The further plane thus deviates at an angle from the main plane of the deviating region, e.g., at an angle of 15–120°, and has a radius of, for example, 4–100 mm. See also FIG. 5.

In addition, the plate can be provided with a further deviating region which deviates from the plane of the further plane which, in turn, is bent over to form another further plane. Thus, for example, the plate can exhibit a main plane, a first deviating region which deviates upward or downward from the main plane, a further plane adjacent to the first deviating region which is parallel to the main plane, a second deviating region which deviates upward or downward from the further plane and a second further plane parallel to or at the same height as the main plane. See, for example, FIG. 6.

According to another embodiment, the plate exhibits a main plane, a first deviating region which deviates upward or downward from the main plane, a second deviating region adjacent the first deviating region which deviates in the opposite direction from the latter, and a further plane adjacent the second deviating region which is parallel to or at the same height as the main plane.

Naturally, it is possible to combine the advantages of one-piece plates whose marginal sections deviate upward and the advantages of plates in which regions deviate downward.

Thus, in tests, plates which proved particularly useful were, for example, one-piece plates whose side regions, deviating downward, can be fitted with millimeter accuracy into a rail-shaped simple frame construction and whose front and back sides were angled upward, for example, as spatter and heat protection.

In a particularly preferred embodiment, at least one region of the one-piece plate which deviates from the main plane of the plate is angled and forms a straight edge.

Here, the regions deviating from or at an angle to the main plane can be up to 50% of the total area of the plate.

The angles and radii which can be achieved are here, first and foremost, determined by the production process used and thereafter by the specifications of the cooking appliance manufacturer.

Reference should here again be made to the fact that, according to the present invention, decorated one-piece glass-ceramic plates whose upper surfaces and undersides even have a different surface contour can also be used for the first time in cooking appliances, in which plates at least one region of the one-piece plate deviates from the main plane of the plate.

In a preferred embodiment it is possible for the deviating regions of the plate to bend over into a further plane at the same height as and/or parallel to the main plane of the plate, so that besides the main plane one or more mostly smaller horizontal areas are formed.

However, it is also possible for regions of the one-piece plate to deviate from the main plane to form truncated cones, segments of spheres and/or cones or even to form prisms, tetrahedra, pyramids and/or frustums thereof.

These regions can be favorable, for example, in the case of open gas burners; although the above-mentioned molded shapes, in particular truncated cones and segments of spheres, then have to have orifices for leading though the gas burners.

Other geometric configurations such as, for example, small cones or prisms can serve as support for pots and pans.

Such regions deviating from the main plane of the plate are also advantageous for, for example, marking the heating regions without decoration.

Large height differences can here not be produced with good results for materials such as glass ceramic using the currently known methods, since otherwise material attenuation, distortion or decoration and contour deformations in the shaped sub-regions result during production. In accordance with the invention, the height difference between the main plane and the deviating region, e.g., a cone, is generally about 1–40 mm, preferably 10–20 mm.

In a particularly preferred embodiment of the invention, one of the regions deviating from the main plane of the plate and/or one of the further planes at the same height as and/or parallel to the main plane of the plate forms a control panel having openings for all controls and displays required for controlling and monitoring the cooking appliance.

The advantages of this arrangement are obvious, since the controls and displays are arranged ergonomically and so as to be readily visible even during all work on the plate of the cooking appliance itself and furthermore are protected by being located outside the region in which overflowing cooking material could reach the controls and/or the associated underlying electrics and/or electronics of the appliance.

In a most preferred embodiment, the regions deviating from the main plane have wall thicknesses which are equal to or smaller than those of the main plane of the one-piece plate. Generally, the thickness of the main plane is about 2–15 mm, preferably 3.8–6.5 mm. For the deviated regions, the thickness is generally about 1.5–15 mm, preferably 3.8–6.5 mm.

The glass-ceramic plate of the invention often has, for stability and safety reasons, different surface contours on the upper surface and underside.

The upper surface of the plate advantageously has a smooth contour which is provided with decoration produced, for example, by means of screen printing.

The decoration is matched, for example, to the respective embodiments of the heating zones under the glass-ceramic plate of the appliance.

The underside of the plate can have a structured contour. The structuring of the underside is in part very distinct, for example, in the form of a knob pattern.

The main plane of the one-piece plate can here have openings and orifices in order, for example, to lead gas burners through.

The following examples of embodiments together with the FIGS. 1–8 and a process example will further clarify the invention.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
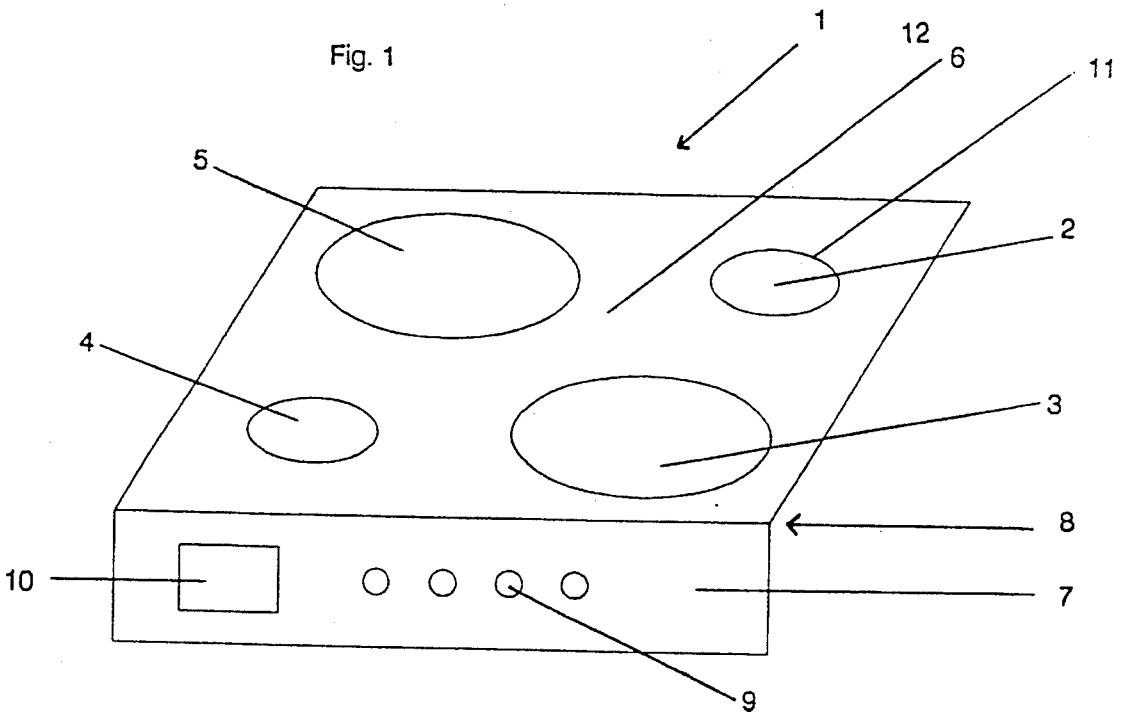
FIGS. 1 and 2 show examples of embodiments having one angled bent edge.

FIG. 1 shows a one-piece plate (1) of glass ceramic as a cooking area having 4 heating regions (2, 3, 4, 5) and a region (7) deviating downward at the front from the main plane (6) of the plate, which region (7) is configured as a control panel. This angled region (7) forms an angle (8) of almost 90° with the main plane (6). The controls (9) and the displays (10) are integrated into the control panel. The decoration (11) is shown here only insofar as it serves to mark the cooking areas (2, 3, 4, 5).

The upper surface (12) here has a surface contour which differs from that of the underside (not shown here).

Figure 2:
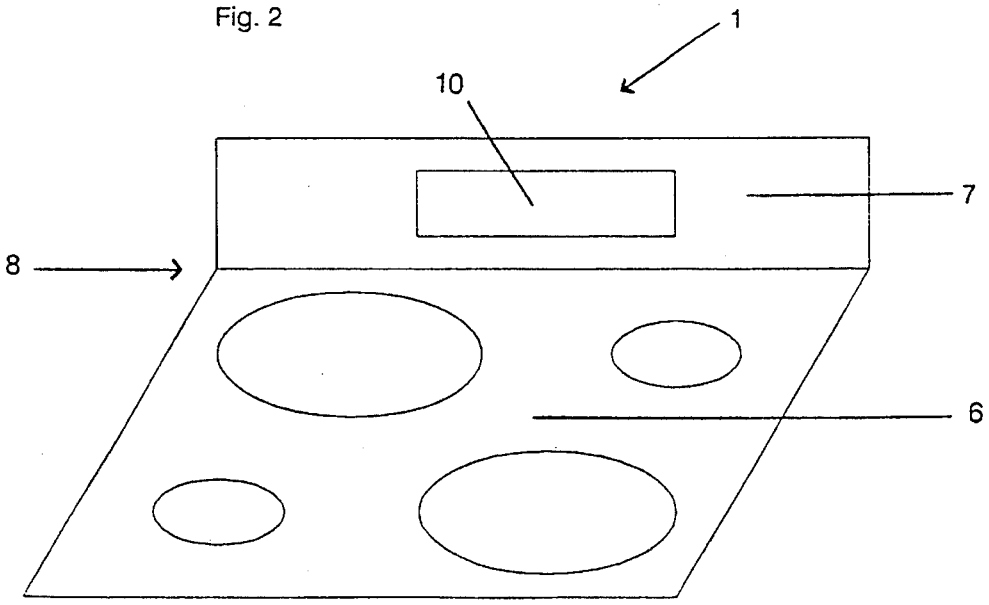

FIG. 2 shows a one-piece glass-ceramic plate (1) whose back region (7) is bent upward from the main plane (6) at an angle (8) of about 90°.

According to FIG. 2 also, displays (10), for example, are provided in the deviating region (7).

Figure 3:
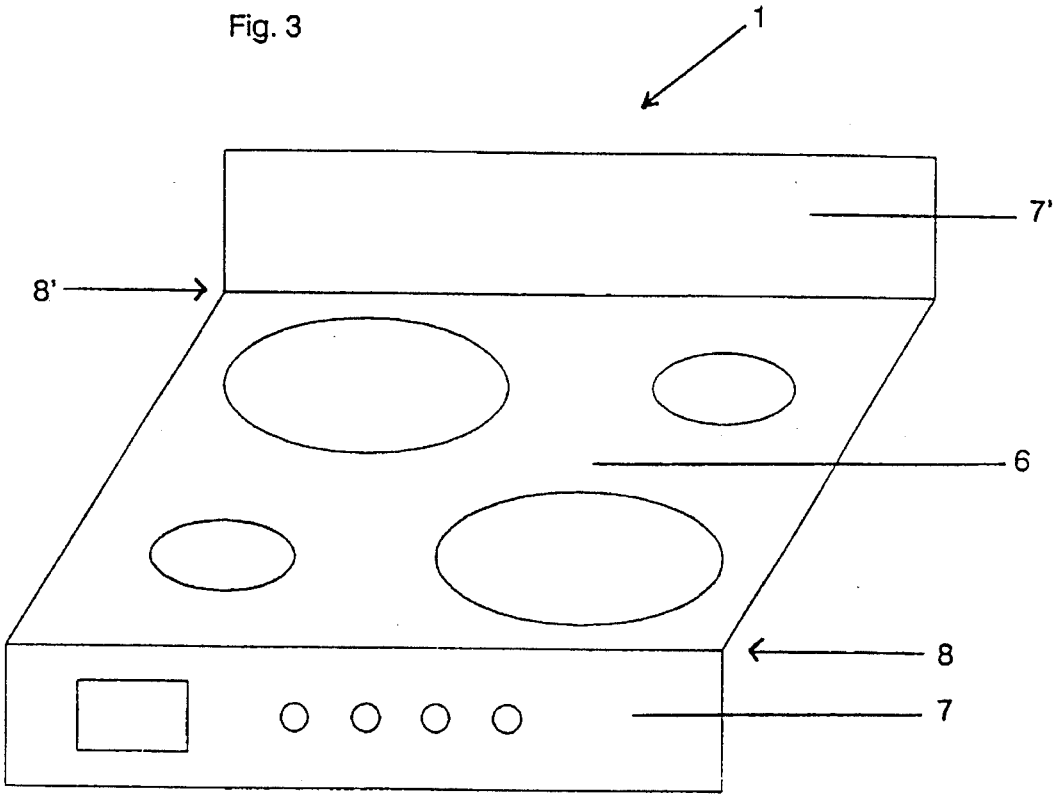
FIGS. 3 and 4 show examples having two bent edges.

FIG. 3 shows a one-piece glass-ceramic plate (1) having two regions (7, 7') deviating from or at an angle to the main plane (6).

The section (7) bent downward at the front is configured as a control panel and here forms an angle (8) of 90° with the main plane (6); the section (7') of the one-piece plate (1) angled upward at the back likewise has an angle (8') of 90°.

Figure 4:
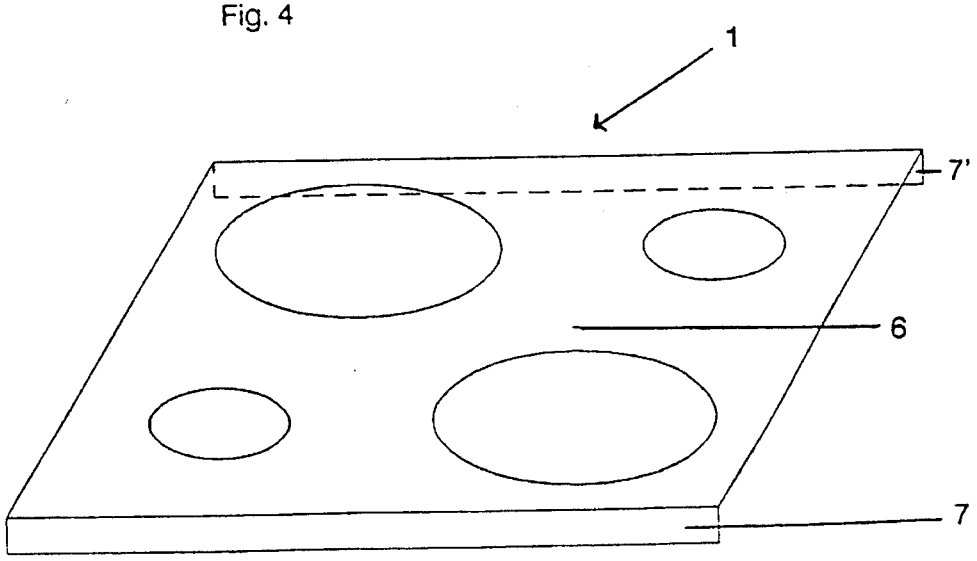

FIG. 4 shows a plate (1) from the main plane (6) of which two regions (7, 7') are bent downward at the front and back.

This plate is, for example, with suitable frame design, very accurately fitting and simple to position.

Figure 5:
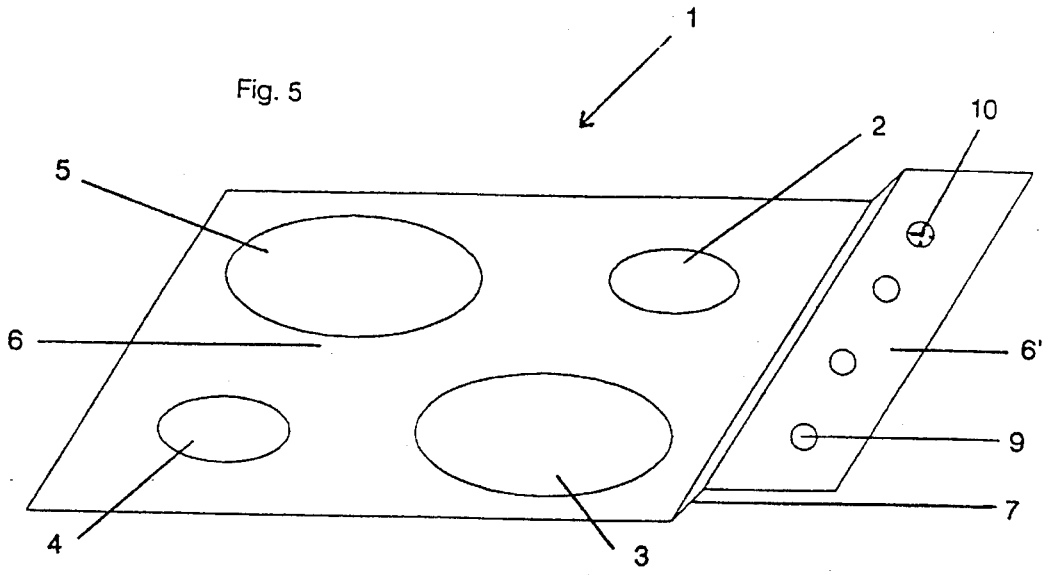
FIGS. 5 and 6 illustrate embodiments wherein the deviating region is bent over to form further planes.

FIG. 5 shows a one-piece plate (1) whose right-hand region (7) is angled out of the main plane of the plate and bends over into a further plane (6') parallel to the main plane (6) of the plate.

The plate (1) has four heating regions (2, 3, 4, 5) on the main plane (6) and on the further plane (6') forms the control panel having the controls (9) and the displays (10).

Precisely this embodiment has, in numerous tests, proven to be particularly advantageous, since the controls are positioned so as to be readily accessible, the displays are arranged so as to be readable at any time in the working area of the plate and there is, at the same time, no danger of controls and display components being damaged by overflowing cooking material.

The plate can also, without any problems, be installed in such a way that the control panel is arranged at the left, which naturally offers advantages, for example, to left-handers in particular.

Figure 6:
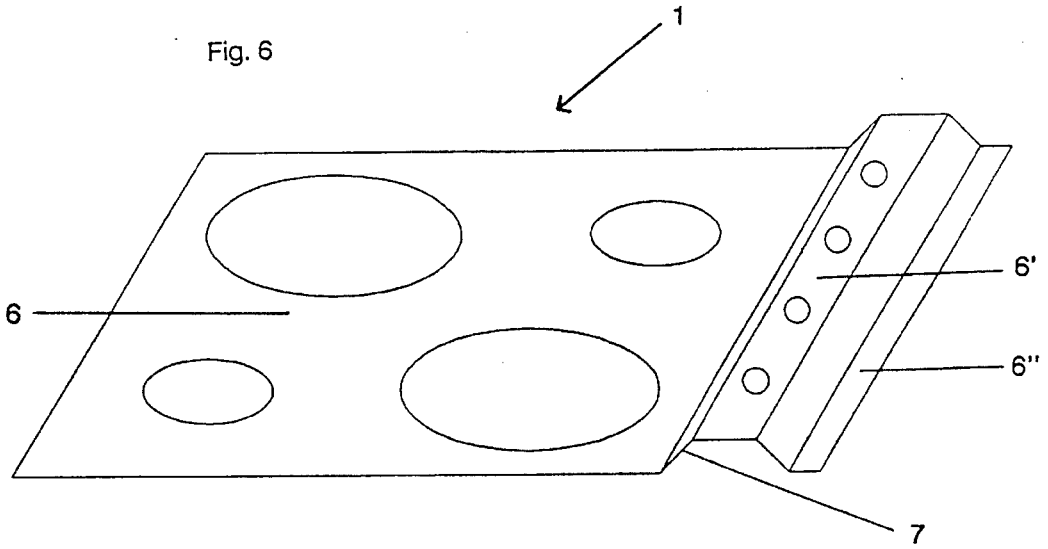

FIG. 6 shows a further possible embodiment of a one-piece plate (1) in which the region (7) deviating upward from the main plane (6) bends over into a further plane (6') parallel to the main plane (6), which then again angles downward and runs out to form a plane (6") at the same height as the main plane (6).

Figure 7:
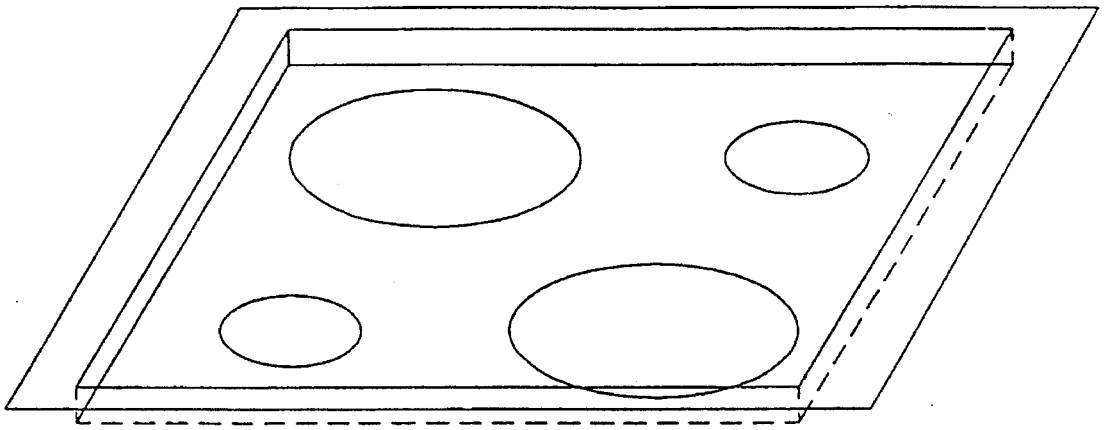
FIGS. 7 and 8 illustrate further embodiments having relatively complicated geometries.
Figure 8:
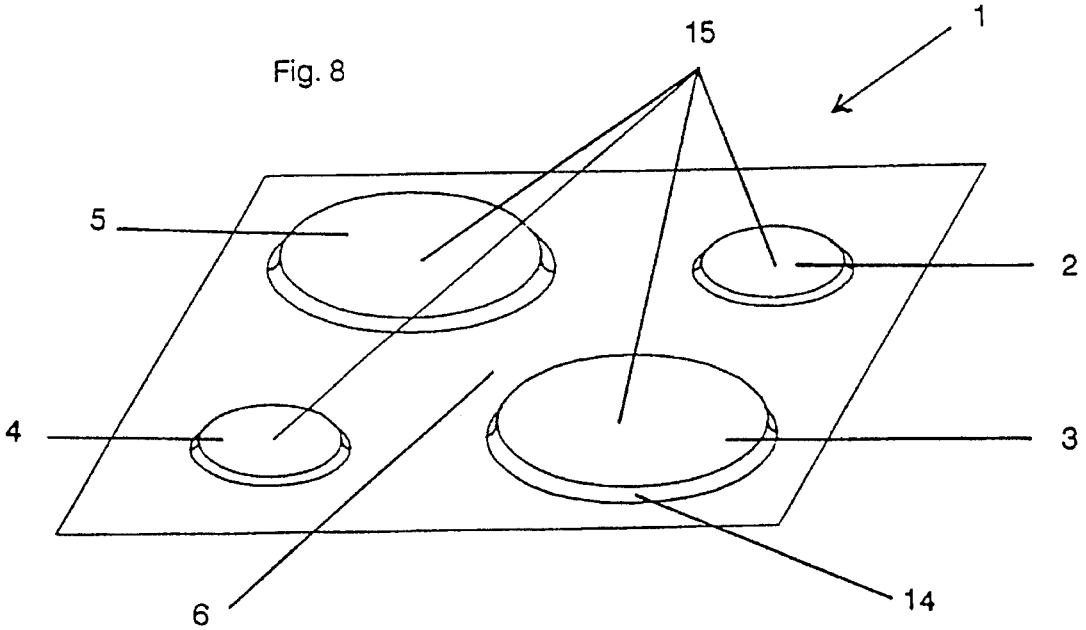

FIGS. 7 and 8 show further embodiments having, in part, relatively complicated geometries which can, however, be realized without any problems according to the invention.

FIG. 7 illustrates an embodiment wherein, at each edge of the main plane, there is provided an upward deviating region which forms an angle of about 90° with the main plane. Each of the deviating regions is bent over to form a further plane parallel to and above the main plane of the plate.

According to FIG. 8, four regions of the one-piece plate deviate from the main plane to form truncated cones (14) which mark the cooking zones (2, 3, 4, 5). The truncated cone (14) has an opening at the top (15), for example, when using open gas burners.

A typical process procedure by which decorated plates having upper surfaces and undersides with different surface contours are produces, as are, for example, shown in FIGS. 1–8, is as follows:

A flat glass plate having dimensions of 480×550×4 mm and a composition (in % by weight based on oxide) of: $SiO_2$ 62–68%; $Al_2O_3$19.5–22.5%; $Li_2O$3.0–4.0%; $Na_2O$0–1.0%; $K_2O$0–1.0%; BaO1.5–3.5%; CaO0–1.0%; MgO0–0.5%; ZnO0.5–2.5%; $TiO_2$1.5–5.0%; $ZrO_2$0–3.0%; $MnO_2$0–0.8%; $Fe_2O_3$0–0.3%; CoO0–0.4%; NiO0–0.3%; $Sb_2O_3$0–2.0%, is produced in a conventional manner and is subsequently decorated by, for example, screen printing.

The shaping of the decorated plate in a mold can, for example, also be achieved by building up a pressure difference, for example, by means of vacuum, or by other known glass-shaping techniques.

The application of a decoration to the plate can occur before or after the shaping. Complicated shaped plates, for example, as shown in FIG. 7, preferably are decorated after shaping. Plates with smooth contours, e.g., as shown in FIG. 1 can be decorated before the shaping.

Suitable shaping techniques of flat glass are known to those skilled in the art, for example, by building up a pressure difference, e.g., by means of vacuum.

By way of example, a decorated or undecorated plate is positioned on a mold. At a temperature corresponding to glass viscosity of about $10^8$ dPas±$10^2$ dPas, shaping is achieved by application of vacuum, either abrupt and fast or slow and smooth, depending on the desired form. The initially flat plate is thereby adapted to the mold form and suitably shaped.

The shaped plates described above having, e.g., cones or prisms, and the embodiment illustrated in FIG. 7 can be produced in this manner.

In this process, the temperature in the furnace follows the course known to all those skilled in the art required for firing of decoration and for ceramization. Suitable ceramization techniques for forming the glass ceramic are described in, for example, H. G. Pfaender, Schott Guide to Glass, p. 162–165 (1983) and U.S. Pat. No. 5,212,122.

After the final cooling, a decorated, shaped and ceramized glass-ceramic plate ready for installation in the cooking appliance is obtained.

The decision technical advantages of the plate of the invention are, for example:

- higher stiffness of the glass-ceramic plate at the same thickness;
- the control panel can be integrated in the angled section of the plate;
- the plate no longer has joints, i.e., easier cleaning and care are possible;
- the drilled holes and passages for all controls can lie high above the maximum level of overflowing material, i.e., maximum protection for the electrics/electronics and thus substantially increased safety;
- it is easier to recycle one material grade than various materials such as, for example, glass ceramic for the cooking plate and metal parts for the control panel;
- the plate is, with a matching frame design, easy to install and repair, since it can be installed or replaced as a complete unit in one step;
- the plate offers good spatter protection during cooking and frying; and
- the process for producing such a plate according to the invention is simple and cheap.

Without further elaboration, it is believed that one skilled in the art can, using the preceding description, utilize the present invention to its fullest extent. The preferred specific embodiments are, therefore, to be construed as merely illustrative, and not limitative of the remainder of the disclosure in any way whatsoever.

In the foregoing, all temperatures are set forth uncorrected in degrees Celsius and unless otherwise indicated, all parts and percentages are by weight.

The entire disclosure of all applications, patents and publications, cited above, and of corresponding German application P 43 33 334.6, filed Sep. 30, 1993, are hereby incorporated by reference.

The preceding can be repeated with similar success by substituting the generically or specifically described materials and/or operating conditions of this invention for those used.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A one-piece glass ceramic plate suitable for use as component of a cooking appliance, said plate comprising:

a main plane and at least one region of said one-piece plate which deviates at an angle, upward or downward, from said main plate of said plate, wherein one of said at least one regions which deviates at an angle from said main plane of said plate forms a control panel having openings for controls and displays, and wherein at least one region of said one-piece plate deviates upward from said main plane of said plate and at least one other region of said one-piece plate deviates downward from said main plane of said plate.

2. A plate according to claim 1, wherein said at least one region deviates from said main plane of said plate at an angle of 15°–120° and has a radius of 4 mm 100 mm.

3. A plate according to claim 1, wherein said at least one region deviating from said main plane of said plate possesses up to 50% of the total area of said plate.

4. A plate according to claim 1, wherein said at least one region deviating from said main plane has a wall thickness which is equal to or smaller than the wall thickness of said main plane.

5. A plate according to claim 4, wherein the wall thickness of said main plane is 2–15 mm and the wall thickness of said at least one region deviating from said main plane is 1.5–15 mm.

6. A plate according to claim 4, wherein the wall thickness of said main plane is 3.8–6.5 mm and the wall thickness of said at least one region deviating from said main plane is 3.8–6.5 mm.

7. A plate according to claim 1, wherein said plate has a different surface contour on its top surface than on its bottom surface.

8. A plate according to claim 7, wherein said top surface is smooth and said bottom surface is contoured.

9. A plate according to claim 1, wherein the upper surface of said one-piece plate is decorated.

10. A plate according to claim 1, wherein said main plane of said one-piece plate has openings for gas burners.

11. A plate according to claim 1, wherein the glass composition used to produce said one-piece glass ceramic plate is, in wt. % based on oxide:

| | |
|---|---|
| $SiO_2$ | 62–68% |
| $Al_2O_3$ | 19.5–22.5% |
| $Li_2O$ | 3.0–4.0% |
| $Na_2O$ | 0–1.0% |
| $K_2O$ | 0–1.0% |
| BaO | 1.5–3.5% |
| CaO | 0–1.0% |
| MgO | 0–0.5% |
| ZnO | 0.5–2.5% |
| $TiO_2$ | 1.5–5.0% |
| $ZrO_2$ | 0–3.0% |
| $MnO_2$ | 0–0.8% |
| $Fe_2O_3$ | 0–0.3% |
| CoO | 0–0.4% |
| NiO | 0–0.3% |
| $Sb_2O_3$ | 0–2.0%. |

12. A one-piece glass ceramic plate suitable for use as component of a cooking appliance, said plate comprising:

a main plane and at least one region of said plate which deviates from said main plane of said plate and which bends over into at least one further plane at the same height as said main plane of said plate, wherein said further plane at the same height as said main plane of said plate forms a control panel having openings for controls and displays.

13. A plate according to claim 12, wherein the glass composition used to produce said one-piece glass ceramic plate is, in wt. % based on oxide:

| | |
|---|---|
| $SiO_2$ | 62–68% |
| $Al_2O_3$ | 19.5–22.5% |
| $Li_2O$ | 3.0–4.0% |
| $Na_2O$ | 0–1.0% |
| $K_2O$ | 0–1.0% |
| BaO | 1.5–3.5% |
| CaO | 0–1.0% |
| MgO | 0–0.5% |
| ZnO | 0.5–2.5% |
| $TiO_2$ | 1.5–5.0% |
| $ZrO_2$ | 0–3.0% |
| $MnO_2$ | 0–0.8% |
| $Fe_2O_3$ | 0–0.3% |
| CoO | 0–0.4% |
| NiO | 0–0.3% |
| $Sb_2O_3$ | 0–2.0%. |

14. A one-piece glass ceramic plate suitable for use as component of a cooking appliance, said plate comprising:

a main plane and at least one region which deviates from said main plane of said plate, wherein said at least one region of the one-piece plate which deviates from said main plane of said plate exhibits a shape selected from a truncated cone, a segment of a sphere, a cone, a prism, a tetrahedron, a pyramid and a frustum.

15. A plate according to claim 14, wherein each region of said plate which deviates from said main plane of sad plate has at least one opening.

16. A plate according to claim 14, wherein the difference in height between said main plane and said at least one region which deviates from said main plane is 1–40 mm.

17. A plate according to claim 14, wherein the difference in height between said main plane and said at least one region which deviates from said main plane is 10–20 mm.

18. A plate according to claim 14, wherein the glass composition used to produce said one-piece glass ceramic plate is, in wt. % based on oxide:

| | |
|---|---|
| $SiO_2$ | 62–68% |
| $Al_2O_3$ | 19.5–22.5% |
| $Li_2O$ | 3.0–4.0% |
| $Na_2O$ | 0–1.0% |
| $K_2O$ | 0–1.0% |
| BaO | 1.5–3.5% |
| CaO | 0–1.0% |
| MgO | 0–0.5% |
| ZnO | 0.5–2.5% |
| $TiO_2$ | 1.5–5.0% |
| $ZrO_2$ | 0–3.0% |
| $MnO_2$ | 0–0.8% |
| $Fe_2O_3$ | 0–0.3% |
| CoO | 0–0.4% |
| NiO | 0–0.3% |
| $Sb_2O_3$ | 0–2.0%. |

19. In a cooking appliance comprising a frame and a cooking surface, wherein said cooking surface comprises a one-piece glass ceramic plate, the improvement wherein said glass ceramic plate comprises:

a main plane and at least one region of said one-piece plate which deviates at an angle, upward or downward, from said main plate of said plate, wherein one of said at least one regions which deviates from said main plane of said plate forms a control panel having openings for controls and displays, and wherein at least one region of said one-piece plate deviates upward from said main plane of said plate and at least one other region of said one-piece plate deviates downward from said main plane of said plate.

20. A plate according to claim 19, wherein the glass composition used to produce said one-piece glass ceramic plate is, in wt. % based on oxide:

| | |
|---|---|
| $SiO_2$ | 62–68% |
| $Al_2O_3$ | 19.5–22.5% |
| $Li_2O$ | 3.0–4.0% |
| $Na_2O$ | 0–1.0% |
| $K_2O$ | 0–1.0% |
| BaO | 1.5–3.5% |
| CaO | 0–1.0% |
| MgO | 0–0.5% |
| ZnO | 0.5–2.5% |
| $TiO_2$ | 1.5–5.0% |
| $ZrO_2$ | 0–3.0% |
| $MnO_2$ | 0–0.8% |
| $Fe_2O_3$ | 0–0.3% |
| CoO | 0–0.4% |
| NiO | 0–0.3% |
| $Sb_2O_3$ | 0–2.0%. |

21. A one-piece glass ceramic plate suitable for use a component of a cooking appliance, said plate comprising:

a main plane and at least one region of said plat which deviates from said main plane of said plate and which bend over into at least one further plane parallel to said main plan of said plate, wherein said further plane parallel to said main plan of said plate forms a control panel having openings for control and displays.

* * * * *